US006350499B1

(12) United States Patent
Babcock

(10) Patent No.: US 6,350,499 B1
(45) Date of Patent: Feb. 26, 2002

(54) SUSPENDED CHRISTMAS TREE

(76) Inventor: Richard D. Babcock, 5213 S. Sweetbriar Ct., Sioux Falls, SD (US) 57108

( * ) Notice: Subject to any disclaimer, the term of this patent is extended or adjusted under 35 U.S.C. 154(b) by 0 days.

(21) Appl. No.: 09/428,379

(22) Filed: Oct. 28, 1999

(51) Int. Cl.[7] ..... A41G 1/00

(52) U.S. Cl. ..... 428/19; 428/20; 428/18; 428/28

(58) Field of Search ..... 428/18, 17, 20, 428/15, 8, 9, 12, 19, 28; 40/617; D21/467; 446/227, 487; D11/118

(56) References Cited

U.S. PATENT DOCUMENTS

| | | | | |
|---|---|---|---|---|
| 3,677,867 A | | 7/1972 | Westlund | 161/14 |
| 3,857,748 A | | 12/1974 | Thomann | 161/24 |
| 4,106,228 A | | 8/1978 | Gibrich | 40/605 |
| 4,186,503 A | * | 2/1980 | Fontana | |
| D256,223 S | | 8/1980 | Byun | D11/118 |
| 4,415,953 A | | 11/1983 | Sheperd | 362/32 |
| 4,428,988 A | * | 1/1984 | Adinamis | |
| 4,968,541 A | | 11/1990 | McCrory | 428/9 |
| 5,486,386 A | | 1/1996 | Rovsek | 428/18 |
| D408,319 S | | 4/1999 | Byers et al. | D11/118 |
| 5,906,869 A | | 5/1999 | Thomas | 428/9 |

* cited by examiner

*Primary Examiner*—Deborah Jones
*Assistant Examiner*—Wendy Boss
(74) *Attorney, Agent, or Firm*—Schwegman, Lundberg, Woessner & Kluth, P.A.

(57) ABSTRACT

A collapsible Christmas tree designed to be suspended in mid-aid from overhead. The tree comprises a central rope threaded through alternating sections of hollow rigid trunk sections and individual or grouped cross members having centered holes. Cross members have a decreasing length and girth as seen from the bottom of the tree to the top. Each cross member is rotated about the rope to resemble the branches of the Christmas tree.

45 Claims, 4 Drawing Sheets

SUSPENDED CHRISTMAS TREE

TECHNICAL FIELD

This invention is concerned with artificial Christmas trees, especially those designed to be suspended in the air after assembly yet collapsible into a smaller package for shipping or storage.

BACKGROUND

There are many known designs of artificial Christmas trees that may be collapsed into a smaller size.

Various forms of collapsible artificial Christmas trees designed to be suspended from above are shown in U.S. Pat. No. 5,906,869 (Thomas); U.S. Pat. No. 4,968,541 (McCrory); U.S. Pat. No. 5,486,386 (Rovsek); U.S. Pat. No. 3,677,867 (Westlund); Ser. No. D408,319 (Byers); and Ser. No. D256,223 (Byun). Each of these designs collapses into a circularly shaped arrangement having the same diameter as the bottom of the tree. A related design, shown in U.S. Pat. No. 4,106,228 (Gibrich), is a collection of flat individual sections, and thus it disassembles into the shape and size of a single section.

The design shown in U.S. Pat. No. 3,857,748 (Thomann) is collapsible to some extent but intended to be mounted on a door or wall. A complicated design incorporating lights is shown in U.S. Pat. No. 4,415,953 (Shepherd).

DISCLOSURE OF INVENTION

The invention is an artificial collapsible Christmas tree designed to be suspended in the air during use, and collapsed into a smaller package for shipping or storage. The package need not be not significantly longer than the diameter of the base of the tree, and generally the container may be a bag, tube or box that is not particularly large in diameter or cross section compared to the package length. This packaging provides a definite advantage to those who sell the invention, as well as those who purchase it and store it between uses.

The parts include a rope (or cord or string) having upper and lower ends; vertical members representing tree trunk segments; and horizontal members representing tree branches. The trunk and branch members are drilled through to permit threading the rope vertically through the center of each trunk segment and through a point centered on the length and width (or diameter) of each branch segment. Trunk segments may (or may not) decrease in length and/or girth from tree bottom to top. They are placed below and between branches with the uppermost trunk member representing the leader of the tree. Branch members progress from maximum length and girth at the bottom of the tree to minimum length and girth at the top. Each branch of lesser size is placed alternatively, from bottom to top, with a trunk segment; or, optionally, equally sized branches may be in clusters, similarly reducing in size from bottom to top. Clustered branches rest upon each other, with the bottom branch of each cluster supported by the trunk segment below.

The bottom end of the rope is knotted or, optionally, secured to an object such is a small block, sphere, disc or other such item resulting in a restriction larger than the hole in the bottom trunk section or branch. Such restriction must be adequate to support the weight of the assembled (and decorated, if applicable) tree. The upper end of the rope is used to attach the tree overhead. Typically, the upper end terminates with a loop or a ring or similar device, which can be slipped over a hook or other hardware device secured to the supporting overhead element from which the assembled tree is to be hung. The length of the rope above the tree element can be varied to accommodate varying heights of supporting elements, so that the tree can relate to the surface under it as the user finds desirable.

Once the rope has been threaded through all the trunk segments and branch members, and the upper end terminated as described above, the completed assembly may be converted into a relatively small package. This is done by letting the rope go slack enough to loosely separate the members while laying the loosened assembly on a horizontal surface; then rolling the assembly into a compact bundle which may be packaged for shipping, or re-packaged or bound for storage by the user.

The user may lay the un-packaged or unbound bundle on a horizontal surface, unroll the assembly, attach the rope upper end to a supporting overhead element, then rotate the branches so the ends are more or less uniformly spread around the tree outer circumference. The assembly is thus suspended and arranged into the shape of a traditional conical Christmas tree. Once erected, the tree could be decorated, if so desired, by the user.

DETAILED DESCRIPTION

Figure 1:
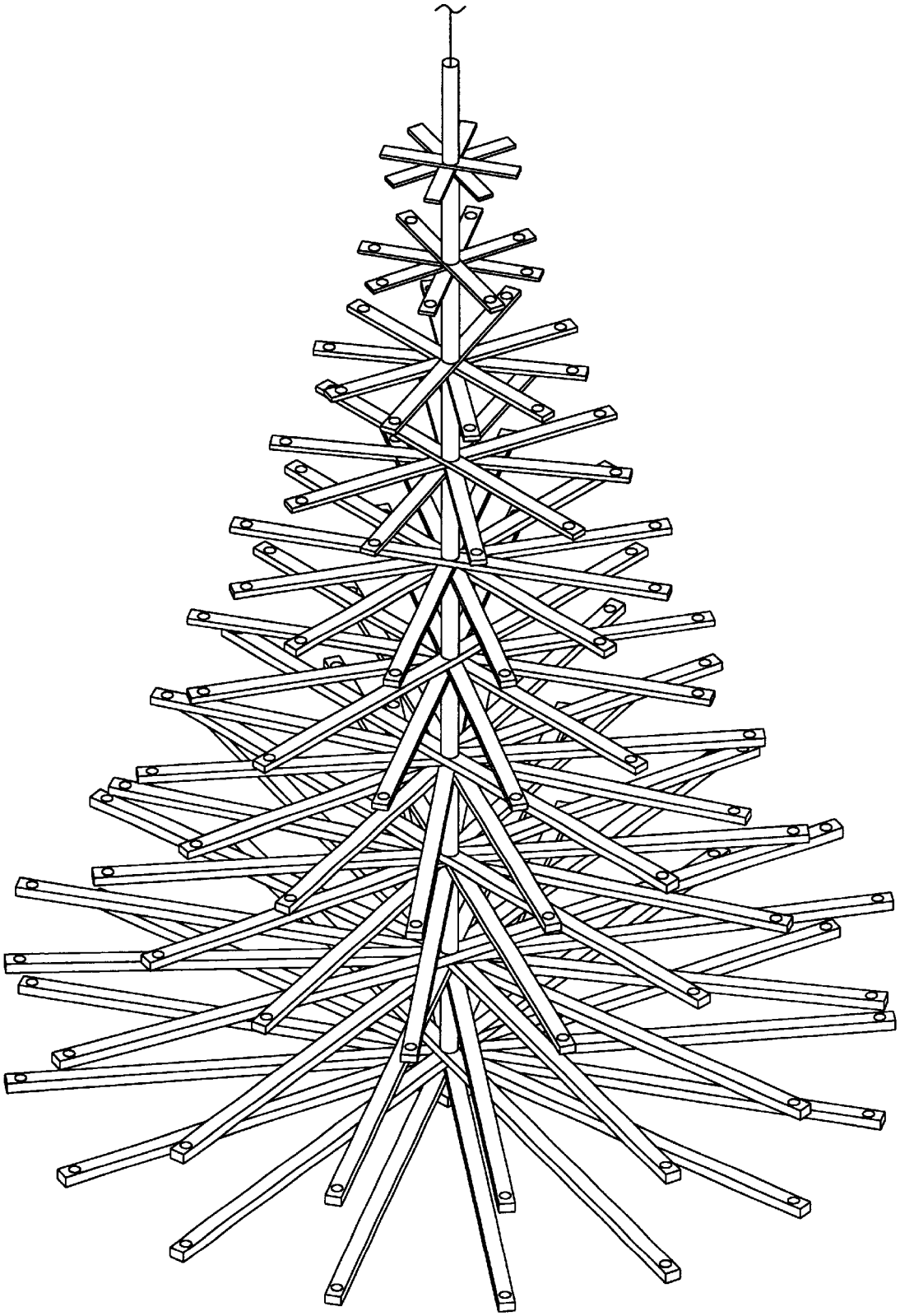
FIG. 1 is a perspective view of a preferred embodiment of the invention.

FIG. 1 is a perspective view of a preferred embodiment of the invention, suspended from a convenient location (not shown) and without any optional decoration. FIG. 1 illustrates the manner in which the branches are rotated uniformly around the outer circumference of the tree to represent the traditional conical Christmas tree. The embodiment of FIG. 1 is a preferred embodiment in two independent respects: (a) branch members having the same length are clustered together and separated by trunk sections; and (b) the trunk sections are equal in length. As will be described in more detail below, neither of these preferences is necessary in the broadest sense of the invention.

Figure 2:
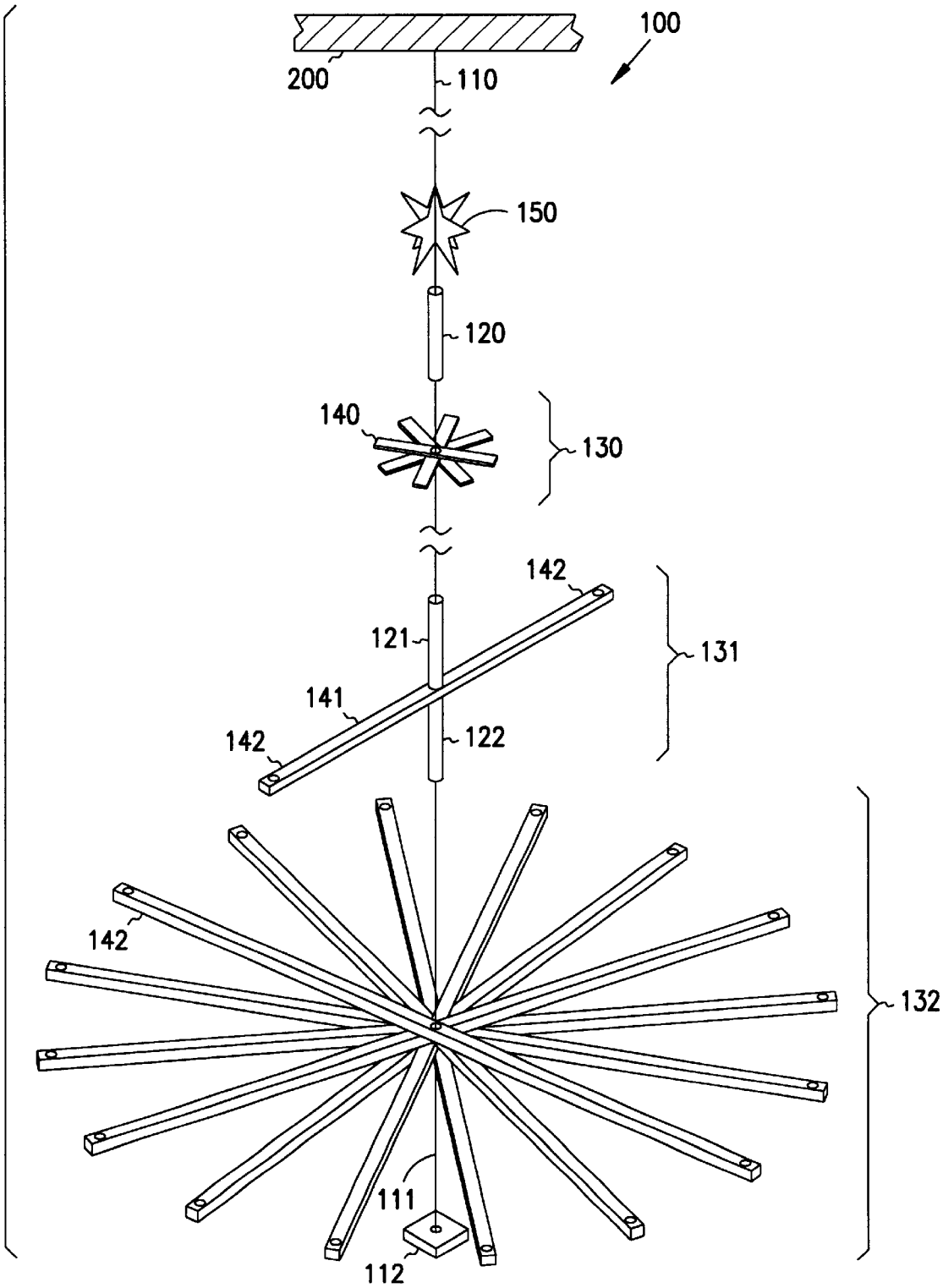
FIG. 2 is a perspective schematic view of a preferred embodiment of the invention.
Figure 3:
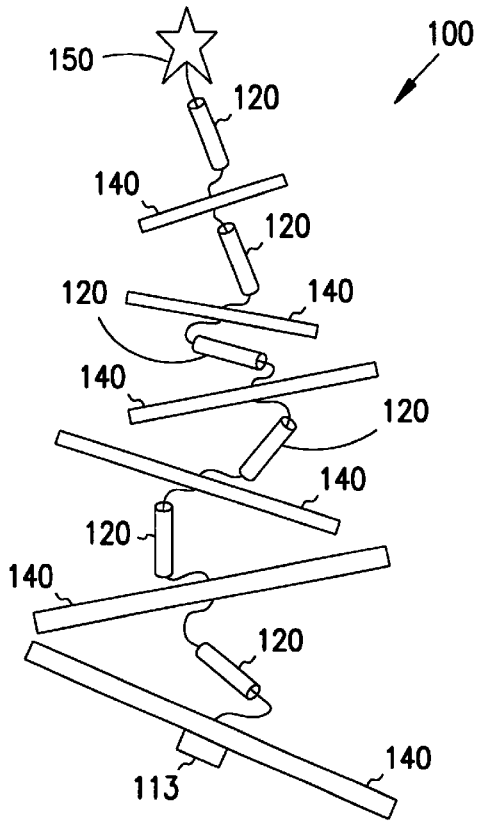
FIG. 3 is a side schematic view of a preferred embodiment of the invention in a partially collapsed configuration.

Solely to illustrate the invention, FIGS. 2 and 3 show fewer components of the invention than would be preferred in a final embodiment, and those components that are shown are spaced apart more than they would be in such an embodiment, shown out of proportion, or both. This is done only for convenience of illustration, and is not intended to limit the scope of the invention in any manner.

Referring now specifically to FIG. 2, collapsible Christmas tree (or, simply, "tree") 100 is shown suspended by gravity by any convenient means (not shown) from any convenient location 200.

Tree 100 is suspended by, and includes as one of its components, rope 110, which runs down the center of tree 100 and through the other components. These components include several pieces of hollow trunk section, such as the sections labeled 120, 121, and 122. Between each pair of adjacent trunk sections are cross members shown in several clusters, such as the three clusters labeled 130, 131, and 132. Cross members need not be clustered, but, instead, may alternate with trunk segments. For purposes of illustration only, cluster 131 includes only a single cross member 141. As shown, cluster 130 includes four cross members, including the representative cross member labeled 140, and cluster 132 includes eight cross members, including the representative cross member labeled 142. Each cross member produces two branches, one on each side of the tree 100. Individual cross members in each cluster are rotated around the rope, and typically they are spaced at approximately the same angle from one another within a cluster. To give tree 100 as much "fullness" in appearance as possible, the rotation angles will be somewhat random from cluster to cluster.

Rope 110 may have an optional lower length labeled 111, which could be used to secure tree 100 to the floor (not shown) or a similar object (such as a suspended weight 112. The additional length and suspended weight are generally not necessary or attractive, and therefore in the preferred embodiment, rope 110 ends immediately beneath the lowest trunk segment, or (as shown) the lowest branch of cluster 132, with a knot, block, sphere, disc, or other suitable object (not shown in FIG. 2, but indicated as 113 in FIG. 3).

Typically the rope is of a material and diameter required to support the weight of the tree 100, which in turn depends of the size and materials chosen for the other members of the assembly and the potential weight of applied decorations.

Trunk sections 120, 121, and 122 are hollow, rigid pieces of wood, metal, plastic and the like. In the preferred embodiment, they are circular cylinders of reducing length and diameter, such as would be formed from hollow dowels, pipe, conduit, etc. In general, the cross section of the trunk elements could be oval, triangular, square, rectangular, etc., and could be constant in length and girth or reduce progressively from tree bottom to top.

The preferred material is wood for trunk sections 120, 121, and 122, which may be produced by drilling an appropriately sized hole in the center of lengths of dowels (in the preferred embodiment). Suitable wood species are birch, maple, oak, pine, spruce, cherry, walnut and the like. The preferred hole diameter in trunk segments and branch members would be uniform in all elements and is slightly larger than the diameter of the rope. The preferred outer width or diameter of trunk segments is less than the width of the cross members contacted.

Cluster 131 contains typical cross member 141, which is shown expanded in size to illustrate the structure of a typical cross member. (It is preferred for appearance and balance considerations that all cross members in any cluster be identical, but this is not required in the broadest sense of the invention).

For clarity, only a single cross member 141 is shown in cluster 131 but this need not be the usual case. Cross member 141 may be any suitable rigid material, and it may have any cross sectional shape and size. In the preferred embodiment, cross member 141 is wood (to match the material and appearance of the trunk sections), and rectangular in cross section. For example cherry pieces approximately one quarter-inch in height and three quarters-inch in width have been used, but the invention is not limited to this example. As with the trunk sections, other suitable wood species are birch, maple, oak, pine, spruce, cherry, walnut and the like. Plastic and metal could also be used as appropriate. The cross section could be circular, oval, triangular, etc. In all cases, the length and girth of trunk segments and branch members will vary as is appropriate for the chosen size of tree assembly.

A central hole (not shown) in cross member 141 is slightly larger in diameter than rope 110, thus permitting passage of rope 110 through cross member 141, as well as rotation of cross member 141 about rope 110. As mentioned above, the hole should not be so large, however, as to allow trunk segments 121 and 122 to slip though, because they must support the weight of the cross members above.

Cross member 141 is supported from below by the top of trunk member 122, and in turn it supports from below the bottom of trunk member 121. (These components are shown expanded along the rope 110 only for clarity). In the usual case in which clusters have multiple cross members, the lowermost cross member in a cluster is supported from below by the top of the lower trunk length, every other cross member in the cluster is supported from below by the cross member immediately beneath it, and the topmost cross member in the cluster supports the bottom of the trunk member immediately above it.

Also shown on cross member 141 are optional holes 142 (one on each branch) which may be used to receive a decorative candle or suitably sized candle holder of any convenient design. The use of holes is preferred, but in the most general case, the branch is adapted in any convenient manner to receive the candle or candle holder. (If tree 10 is constructed of wood or other flammable material, the candles should not actually be lighted, to avoid a fire hazard.) Of course, holes 142 should be provided in evenly-spaced pairs on opposite branches so that the weights of any candles or candleholders balance against each other. The location shown is at the outermost end of the cross member, but this is only preferred as the holes could be closer to the center of the tree. It is also possible to have more than one hole on each branch, but this is not preferred because it does not resemble the traditional location of candles on a Christmas tree. For convenience in decoration, it is preferred that all cross members have holes 142, but this is not required.

Figure 4:
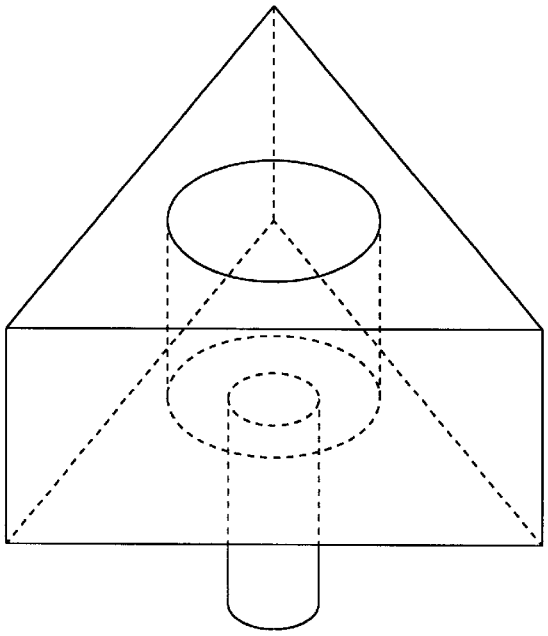
FIG. 4 is a perspective view of a preferred embodiment of a candle holder particularly adapted for use with a preferred embodiment of the invention.

FIG. 4 shows a preferred design for a candle holder that has been found to be attractive in use with the preferred embodiment of the tree without presenting problems of weight, balance, or space. It is a triangular block having a large hole on its upper face to receive the base of the candle, and a dowel (or similar feature) projecting down from its lower face to fit into the holes in the cross members. The candle holder preferably is made of the same material as the cross members, but this is not required.

Returning to FIG. 2, optional star 150 could be added above the topmost cluster 130, separated from that cluster by trunk segment 120.

In any embodiment of the invention, the number of branches or clusters of branches, the number of cross members in each cluster, the length of each cross member, and the length of each trunk segment, are all independent factors none of which is critical to the scope of the invention. However, the tree will resemble a traditional Christmas tree in shape and size when each of the factors is balanced against the other to make a pleasing design.

For example, a tree incorporating clusters of branches and suitable for suspension from a height of eight feet or more (allowing eight inches of ground clearance), could be approximately six feet in height, and comprise ten clusters separated by trunk segments averaging five inches in length. The topmost cluster would have four cross members, each about six to eight inches in length (i.e., eight branches of three to four inches in length, measured from the trunk), and the lowermost cluster would have eight cross members, each approximately fifty-four inches in length (i.e., sixteen branches of approximately twenty-seven inches in length). To produce a symmetrically shaped tree, the length and girth of each cross member in a given cluster should be the same. The length and girth of cross members would gradually increase in each cluster that is progressively below the topmost cluster. Similarly, the number of cross members in each cluster would increase progressively to give the tree a fuller complement of branches at lower levels.

The clean lines of the tree, and the effect of suspending it in mid-air, produce an attractive appearance without any additional decorations. However, it is perfectly within the scope of the invention to hang a variety of decorations (not shown), such as figurines, ornaments, lights, garland, etc., on the branches in any convenient manner. In the case of lights, it is possible to adapt various grooves and other features into the components of the tree to support or hide electrical cords. The suspended tree may be rotated to facilitate application of decorations.

On the whole, the simplicity and elegance of the invention are enhanced when it is manufactured from naturally colored wood (with or without applied finish) such as birch, cherry or walnut, suspended in mid-air, and decorated with traditional candles and a variety of widely available ornaments and figurines.

In the preferred process of assembling the tree, the lower end of the rope is prepared (e.g., a knot is tied in it), the upper end is threaded through trunk sections alternated with individual or clustered cross members.

Referring now to FIG. 3, if the tree is not to be raised into place immediately, it may be packed into a fairly small package by letting the rope go slack, so that the clusters of cross members lie next to each other in a "fan folded" arrangement, but they are still separated by trunk segments. The collapsed assembly may then be bundled into a tightly wrapped package and stored or shipped rather easily. The storage or shipping container will be only slightly longer than the length of the longest cross members (those of the lowest cluster). The container may be circular, or square, or any convenient shape in cross section, but even for a tree having many clusters any many total cross members, the container will not be particularly large in diameter or cross section compared to its length. This feature is desirable to shippers, retailers, and owners of the invention.

When it is finally desired to raise the tree into place, the upper end of rope is simply attached overhead, suspending the assembly in mid-air with each trunk section and cross member held in place by the weight of members above. Then, each cross member is rotated around the rope to expose all the branches.

Of course, some of these steps could be performed in a different order, especially if all the individual parts of the invention were assembled at the final destination instead of being assembled for shipment as described above. For example, while it is not believed to be feasible, it is possible that one could rotate the cross members into place before hanging the upper end of the rope overhead, but this risks having the cross members rotate out of place during hanging. Or, one could pass the rope through all the pipe segments and cross members without first tying the knot, then attach the upper end overhead while temporarily holding the lower end so nothing falls off the rope. This allows one to adjust the distance between the floor and the bottom of the tree without having to un-attach the rope at the upper end. In this example, the cross members could be arranged around the rope before or after the knot is tied, as described above. In general, tying a knot in the lower end of the rope (or otherwise fixing an object in place at the lower end) can be performed at anytime.

Figure 5:
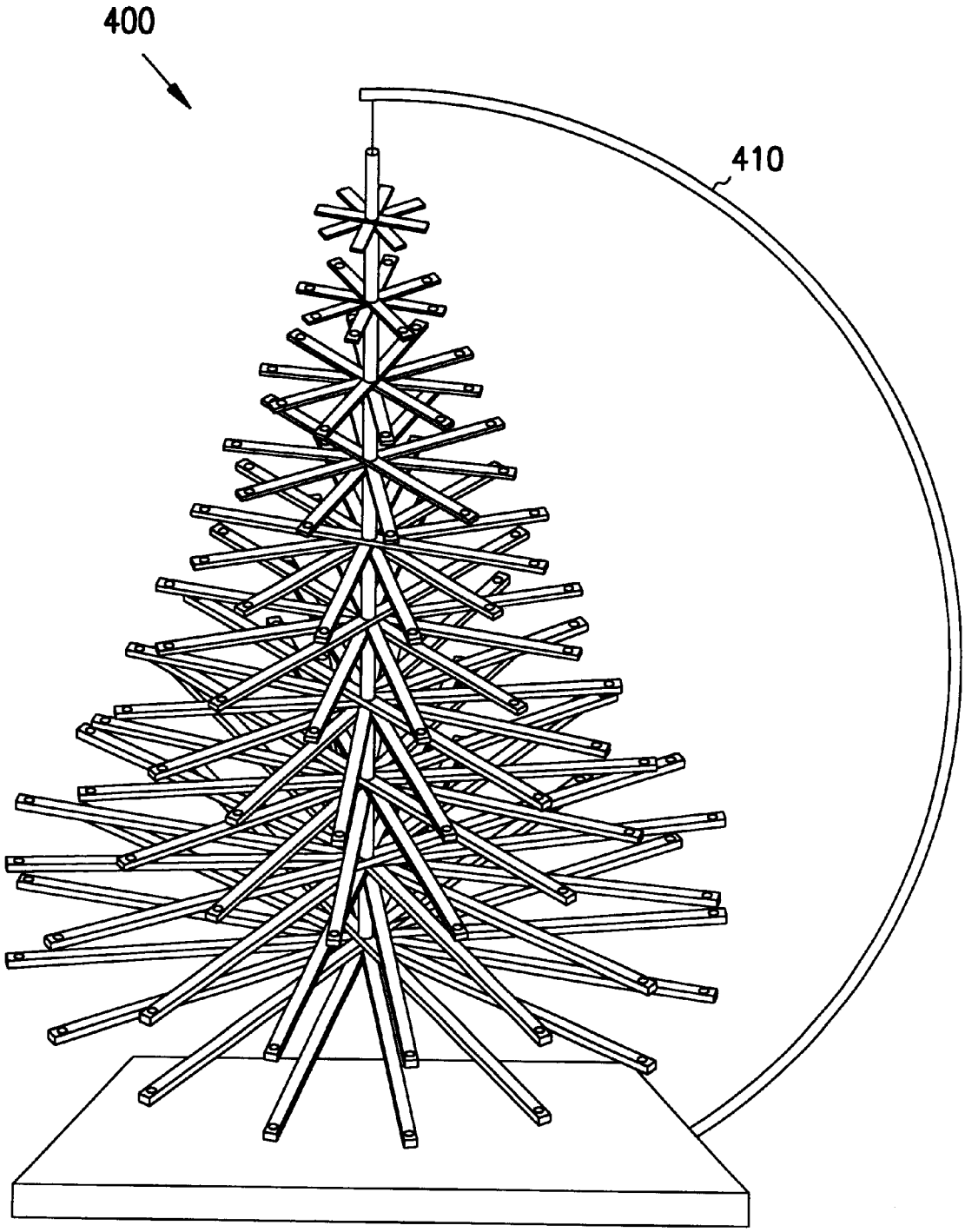
FIG. 5 is a side schematic view of another embodiment of the invention.

In all embodiments of the invention, it should be understood that "overhead" is used here in a common sense manner, assuming the tree is roughly the size of an adult or larger. Smaller embodiments of the invention are possible, and for those embodiments, the term "overhead" simply refers to a suitable point above the space in which the tree is suspended. For example, FIG. 5 shows a "table top" embodiment of the invention, labeled 400, suspended "overhead" from a holder 410 that is similar to those used to hold a bunch of bananas in the air. Similarly, other embodiments of the invention could be suspended from a chandelier, the bottom of a kitchen cabinet, the underside of a fireplace mantle, etc.

The term "rope" is also used here in a common sense manner, and it intended to include any strong line, cord, string, twine, wire, cable, clothesline, etc., whether monofilament, stranded, braided, or some other form.

The flexibility of rope described above is highly preferred, but it is not critical to the invention in its broadest sense. Thus, it should be understood that the term "rope" is considered equivalent to rigid shafts such as rods, lengths of pipe, and the like. In fact, the rope and the trunk sections could be considered together as the "shaft" of the assembly, since they work together to define the central axis of symmetry, support the weight of the cross members, define the spacing of the clusters, etc.

When a shaft is used, the process of "threading" trunk segments and cross members over the rope, as described above, is equivalent to any process of placing such parts in their proper spaced relationship along the shaft. For example, several lengths of threaded rod or pipe could be used to perform the functions of the rope as described above, and in some embodiments such rod or pipe could also simultaneously perform the functions of trunk segments as described above. Such an embodiment might produce a tree that resembled the embodiment using a rope and pipe segments, but it would add unnecessary weight, cost and complexity to the tree, and therefore it is not preferred although it is considered to be within the scope of the invention.

This discussion shows that there are several alternative embodiments of the invention that are possible in addition to the preferred embodiment described above. All such embodiments, and their equivalents, are considered to be within the scope of the invention as defined by the following claims.

I claim:

1. A collapsible Christmas tree, comprising:

a) a rope having upper and lower ends, b) a knot or an object attached to the lower end of the rope, c) a plurality of hollow rigid vertical segments sized to fit over the rope, and d) a plurality of cross members, each cross member having a centered hole large enough to permit passage of the rope through the centered hole, in which the entire tree may be suspended in the air by attaching the upper end of the rope overhead and letting the cross members and the hollow vertical segments hang on the rope, held by the knot or object attached at the lower end of the rope, such that the rope alternately passes through the vertical segments and the cross members, and each cross member is rotated around the rope, wherein the cross members are arranged in a plurality of clusters, the cross members of any such cluster having equal lengths.

2. The collapsible Christmas tree of claim 1 in which the lengths of clustered cross members increase from the upper end to the lower end of the rope.

3. The collapsible Christmas tree of claim 1 in which the cross members increase in length from the upper end to the lower end of the rope.

4. The collapsible Christmas tree of claim 1 in which at least one cross member is adapted to receive a candleholder or candle.

5. The collapsible Christmas tree of claim 1 in which at least one cross member has at least one hole to receive a candleholder or candle.

6. The collapsible Christmas tree of claim 1 in which the cross members are rectangular in cross section.

7. The collapsible Christmas tree of claim 1 in which the hollow vertical members are circular in cross section.

8. The collapsible Christmas tree of claim 1 in which the cross members are formed of rigid material.

9. The collapsible Christmas tree of claim 1 in which the cross members are formed of wood.

10. The collapsible Christmas tree of claim 1 in which the hollow vertical members are formed of rigid material.

11. The collapsible Christmas tree of claim 1 in which the hollow vertical members are wood.

12. A collapsible Christmas tree, comprising:

a) a rope having upper and lower ends, b) a knot or an object attached to the lower end of the rope, c) a plurality of hollow rigid vertical segments sized to fit over the rope, and d) a plurality of cross members, each cross member having a centered hole large enough to permit passage of the rope through the centered hole, in which the entire tree may be suspended in the air by attaching the upper end of the rope overhead and letting the cross members and the hollow vertical segments hang on the rope, held by the knot or object attached at the lower end of the rope, such that the rope alternately passes through the vertical segments and the cross members, and each cross member is rotated around the rope, wherein at least one cross member is adapted to receive a candleholder or candle.

13. The collapsible Christmas tree of claim 12 in which at least one cross member has at least one hole to receive a candleholder or candle.

14. The collapsible Christmas tree of claim 12 in which the hollow vertical members are formed of rigid material.

15. The collapsible Christmas tree of claim 12 in which the hollow vertical members are wood.

16. The collapsible Christmas tree of claim 12 in which the cross members increase in length from the upper end to the lower end of the rope.

17. The collapsible Christmas tree of claim 12 in which the cross members are rectangular in cross section.

18. The collapsible Christmas tree of claim 12 in which the hollow vertical members are circular in cross section.

19. The collapsible Christmas tree of claim 12 in which the cross members are formed of rigid material.

20. The collapsible Christmas tree of claim 12 in which the cross members are formed of wood.

21. The collapsible Christmas tree of claim 12 further comprising a candle holder.

22. The collapsible Christmas tree of claim 12 further comprising a candle.

23. The collapsible Christmas tree of claim 12 in which the cross members are arranged in a plurality of clusters, the cross members of any such cluster having equal lengths.

24. The collapsible Christmas tree of claim 23 in which the lengths of clustered cross members increase from the upper end to the lower end of the rope.

25. The collapsible Christmas tree of claim 13 further comprising a candle holder which is assembled by a process comprising inserting a candleholder into the at least one hole for receiving the candle holder or candle.

26. The collapsible Christmas tree of claim 13 further comprising a candle holder which is assembled by a process comprising inserting a candle into the at least one hole for receiving the candle holder or candle.

27. A collapsible Christmas tree, comprising:

a) a rope having upper and lower ends, b) a knot or an object attached to the lower end of the rope, c) a plurality of hollow rigid vertical segments sized to fit over the rope, and d) a plurality of cross members, each cross member having a centered hole large enough to permit passage of the rope through the centered hole, in which the entire tree may be suspended in the air by attaching the upper end of the rope overhead and letting the cross members and the hollow vertical segments hang on the rope, held by the knot or object attached at the lower end of the rope, such that the rope alternately passes through the vertical segments and the cross members, and each cross member is rotated around the rope, wherein the hollow vertical members are wood.

28. The collapsible Christmas tree of claim 27 in which the cross members increase in length from the upper end to the lower end of the rope.

29. The collapsible Christmas tree of claim 27 in which the cross members are arranged in a plurality of clusters, the cross members of any such cluster having equal lengths.

30. The collapsible Christmas tree of claim 27 in which the lengths of clustered cross members increase from the upper end to the lower end of the rope.

31. The collapsible Christmas tree of claim 27 in which at least one cross member is adapted to receive a candleholder or candle.

32. The collapsible Christmas tree of claim 27 in which at least one cross member has at least one hole to receive a candleholder or candle.

33. The collapsible Christmas tree of claim 27 in which the cross members are rectangular in cross section.

34. The collapsible Christmas tree of claim 27 in which the hollow vertical members are circular in cross section.

35. The collapsible Christmas tree of claim 27 in which the cross members are formed of rigid material.

36. The collapsible Christmas tree of claim 27 in which the cross members are formed of wood.

37. The collapsible Christmas tree of claim 27 in which the hollow vertical members are formed of rigid material.

38. The collapsible Christmas tree of claim 27 in which the hollow vertical members are made of wood.

39. A collapsible Christmas tree, comprising:

a) a plurality of segments of shafts which form a shaft having an upper end, and b) a plurality of cross members, each cross member having a centered hole large enough to permit passage of the shaft through the centered hole, in which the entire tree may be suspended in the air by attaching the upper end of the shaft overhead and letting the cross members hang on the shaft downward, such that the shaft segments and the cross members alternate with each other, and each cross member is rotated around the shaft, wherein the cross members are arranged in a plurality of clusters, the cross members of any such cluster having equal lengths.

40. The collapsible Christmas tree of claim 39 in which the lengths of the clustered cross members increase from the upper end to the lower end of the shaft.

41. A collapsible Christmas tree, comprising:

a) a plurality of segments of shafts which form a shaft having an upper end, and b) a plurality of cross members, each cross member having a centered hole large enough to permit passage of the shaft through the centered hole, in which the entire tree may be suspended in the air by attaching the upper end of the shaft overhead and letting the cross members hang on the shaft downward, such that the shaft segments and the cross members alternate with each other, and each cross member is rotated around the shaft, wherein at least one cross member is adapted to receive a candleholder or candle.

42. The collapsible Christmas tree of claim 41 in which the cross members increase in length from the upper end to the lower end of the shaft.

43. The collapsible Christmas tree of claim 41 in which at least one cross member has at least one hole to receive a candleholder or candle.

44. The collapsible Christmas tree of claim 41 further comprising hollow vertical members sized to fit over the shaft segments in which the hollow vertical members are wood.

45. The collapsible Christmas tree of claim 44 in which the hollow vertical members are chosen from the group consisting of birch, maple, oak, pine, spruce, cherry and walnut.

* * * * *